US009482025B2

(12) United States Patent
Ludlow

(10) Patent No.: US 9,482,025 B2
(45) Date of Patent: Nov. 1, 2016

(54) FOLDABLE TENT

(71) Applicant: Brian J. Ludlow, Sanford, FL (US)

(72) Inventor: Brian J. Ludlow, Sanford, FL (US)

( * ) Notice: Subject to any disclaimer, the term of this patent is extended or adjusted under 35 U.S.C. 154(b) by 0 days.

(21) Appl. No.: 14/510,745

(22) Filed: Oct. 9, 2014

(65) Prior Publication Data

US 2016/0102474 A1 Apr. 14, 2016

(51) Int. Cl.
*E04H 15/48* (2006.01)
*E04H 15/46* (2006.01)
*E04H 15/56* (2006.01)

(52) U.S. Cl.
CPC ..... *E04H 15/48* (2013.01); *E04H 15/46* (2013.01); *E04H 15/56* (2013.01)

(58) Field of Classification Search
CPC ..... E04H 15/56; E04H 15/48; E04H 15/008; A01K 97/22; Y10S 135/905
USPC ..... 135/137, 148–150, 116, 88.07, 88.14; 52/79.2, 79.5
See application file for complete search history.

(56) References Cited

U.S. PATENT DOCUMENTS 2,415,343 A 2/1947 Dunn
2,804,083 A 8/1957 Wieber
3,712,316 A * 1/1973 Leonard ..... B60P 3/38 135/116
4,058,133 A * 11/1977 Barr ..... B60P 3/38 135/132
4,239,247 A * 12/1980 Hinz ..... E04H 15/001 135/133
4,271,856 A 6/1981 Ferguson
4,415,066 A * 11/1983 Mensik ..... B60P 3/14 135/87
4,585,020 A 4/1986 Masuda et al.
4,830,036 A * 5/1989 Sanders ..... E04H 15/06 135/132
5,205,089 A 4/1993 Cunningham
5,271,423 A * 12/1993 Eychaner ..... E04H 15/001 135/134
5,368,057 A * 11/1994 Lubkeman ..... E04H 15/001 135/133
5,622,198 A * 4/1997 Elsinger ..... E04B 1/344 135/116
5,839,462 A 11/1998 Randall
5,908,043 A 6/1999 Paes et al.
6,209,741 B1 * 4/2001 Boucher-Giles ... B65D 11/1833 220/4.28

(Continued)

*Primary Examiner* — Winnie Yip
(74) *Attorney, Agent, or Firm* — Foley & Lardner LLP

(57) ABSTRACT

One embodiment of the invention relates to a self-contained folding shelter, including a rigid base with a first base portion and a second base portion and a hinge coupled to the first base portion and the second base portion. The hinge defines a hinge axis such that the first base portion and the second base portions are pivotally movable between an open configuration and a closed configuration. The folding shelter further includes a first pair of rail members disposed along the sides of the first base portion and a second pair of rail members disposed along the sides of the second base portion. The first and second pairs of rail members extend generally orthogonal to the hinge axis. The first pair of rail members are aligned with the second pair of rail members when the first and second base portions are in the open configuration. The folding shelter further includes a plurality of frame members, each of the frame members having a pair of ends spaced apart and movably coupled to the plurality of rail members such that each frame member is configured to pivot relative to the rail members and translate along the length of the rail members. The folding shelter further includes a cover supported by the frame members to define an interior space, and a panel coupled to the rigid base. The panel is pivotable between a substantially horizontal position and a substantially vertical position. The panel is coupled to an edge of the cover when in the vertical position and configured to pass electrical power to the interior space. In the closed configuration, the rigid base defines a storage space sized to receive the plurality of frame members, the cover, and the panel.

20 Claims, 9 Drawing Sheets

(56) References Cited

U.S. PATENT DOCUMENTS

| | | | | |
|---|---|---|---|---|
| 7,543,411 | B2 * | 6/2009 | Whitehead | E04B 1/34321 52/66 |
| 8,109,402 | B2 * | 2/2012 | Hartwall | B65D 19/18 206/600 |
| 8,491,192 | B2 | 7/2013 | Brensinger et al. | |
| 2012/0031321 | A1 | 2/2012 | Ying | |
| 2012/0031448 | A1 | 2/2012 | Brensinger et al. | |
| 2012/0167484 | A1 * | 7/2012 | Bernard | A45C 7/0077 52/79.5 |

* cited by examiner

FOLDABLE TENT

BACKGROUND

The present invention relates generally to portable shelters. Portable shelters such as tents provide a temporary, relatively quickly erected shelter from the elements. Traditional tents typically feature a flexible fabric floor and walls that are supported by an internal or an external frame. Tents may be utilized for recreation or in other situations, such as by military personnel or by medical personal. Tents are often erected on uneven ground. As tents often include flexible fabric floors, this can result in an uneven surface inside the tent, even if care is taken to clear or smooth out an area before erecting the tent. Tents are often used with an additional ground sheet formed of a rugged, moisture-resistant material disposed between the tent and the ground. While such ground sheets can provide a barrier between the tent and moisture in the ground, any precipitation or accumulation of liquid on the ground is unable to pass under the tent and is forced to flow around or through the tent.

SUMMARY

One embodiment relates to a self-contained folding shelter, including a rigid base with a first base portion and a second base portion and a hinge coupled to the first base portion and the second base portion. The hinge defines a hinge axis such that the first base portion and the second base portions are pivotally movable between an open configuration and a closed configuration. The folding shelter further includes a first pair of rail members disposed along the sides of the first base portion and a second pair of rail members disposed along the sides of the second base portion. The first and second pairs of rail members extend generally orthogonal to the hinge axis. The first pair of rail members are aligned with the second pair of rail members when the first and second base portions are in the open configuration. The folding shelter further includes a plurality of frame members, each of the frame members having a pair of ends spaced apart and movably coupled to the plurality of rail members such that each frame member is configured to pivot relative to the rail members and translate along the length of the rail members. The folding shelter further includes a cover supported by the frame members to define an interior space, and a panel coupled to the rigid base. The panel is pivotable between a substantially horizontal position and a substantially vertical position. The panel is coupled to an edge of the cover when in the vertical position and configured to pass electrical power to the interior space. In the closed configuration, the rigid base defines a storage space sized to receive the plurality of frame members, the cover, and the panel.

Another embodiment relates to a self-contained folding tent, including a rigid base having a first rigid base portion, a second rigid base portion, and a hinge. The first rigid base portion includes a protrusion extending outward from a hinge edge and a plurality of ribs on a bottom surface defining a plurality of channels therebetween. The second rigid base portion includes a recess extending inward from a hinge edge and a plurality of ribs on a bottom surface defining a plurality of channels therebetween. The hinge defines a hinge axis and is coupled to the hinge edge of the first rigid base portion and hinge edge of the second rigid base portion. The first rigid base portion and the second rigid base portions are pivotable about the hinge axis between an open configuration and a closed configuration. In the open configuration, the protrusion is received in the recess. The folding tent further includes a first pair of rail members disposed along the sides of the first rigid base portion and a second pair of rail members disposed along the sides of the second rigid base portion. The rail members extend in a direction generally orthogonal to the hinge axis. The first pair of rail members are aligned with the second pair of rails when the tent is in the open configuration. The folding tent further includes a plurality of frame members. Each of the frame members includes a pair of ends spaced apart in a direction parallel to the hinge axis and coupled to the plurality of rail members such that the frame member is able to pivot about an axis orthogonal to the rail members and translate along the length of the rail members. The folding tent further includes a locking member configured to be slidably disposed along a rail member. The locking member is moveable between an unlocked position in which it is disposed along a rail member on the first rigid base portion and a locked position in which it is extends across the hinge axis to be disposed along the rail member on the first rigid base portion and an aligned rail member on the second rigid base portion to prevent the pivoting of the first rigid base portion relative to the second rigid base portion. The folding tent further includes a cover and a panel coupled to the rigid base. The cover is formed from a flexible, waterproof material. The cover has an outer peripheral edge coupled to the rigid base in a weatherproof manner and is supported by the frame members to define an interior space. The panel is pivotable between a horizontal position and a vertical position. The panel is coupled to an edge of the cover in a weather proof manner when in the vertical position and configured to pass electrical power through the cover to the interior space. In the closed configuration, the rigid base defines a storage space sized to receive the plurality of frame members, the cover, and the panel.

Still another embodiment relates to a folding frame for a flexible cover. The folding frame includes a rigid base, a hinge, a plurality of frame members, a locking member, and a panel coupled to the rigid base. The rigid base includes a first rigid base portion and a second rigid base portion arranged end to end along adjacent edges. The hinge is coupled to the first rigid base portion and the second rigid base portion. The first rigid base portion and the second rigid base portions are pivotable about a hinge axis defined by the hinge between an open configuration and a closed configuration. Each of the frame members includes a pair of ends spaced apart in a direction parallel to the pivot axis and coupled to the plurality of rail members such that the frame member is able to pivot about an axis orthogonal to the rail members and translate along the length of the rail members. The locking member is configured to be slidably disposed along a rail member. The locking member is moveable between an unlocked position in which it is disposed along a rail member on the first rigid base portion and a locked position in which it is extends across the pivot axis to be disposed along the rail member on the first rigid base portion and an aligned rail member on the second rigid base portion to prevent the pivoting of the first rigid base portion relative to the second rigid base portion. The panel is pivotable between a horizontal position and a vertical position. The panel is configured to pass electrical power through the flexible cover to the interior space. In the open configuration, the frame members support the flexible cover to define an interior space. In the closed configuration, the rigid base defines a storage space sized to receive the plurality of frame members, the flexible cover, and the panel.

It is to be understood that both the foregoing general description and the following detailed description are exemplary and explanatory only, and are not restrictive of the invention as claimed.

BRIEF DESCRIPTION OF THE DRAWINGS

Features, aspects, and advantages of the present disclosure will become apparent from the following description, appended claims, and the accompanying exemplary embodiments shown in the drawings, which are briefly described below.

DETAILED DESCRIPTION

Figure 1:
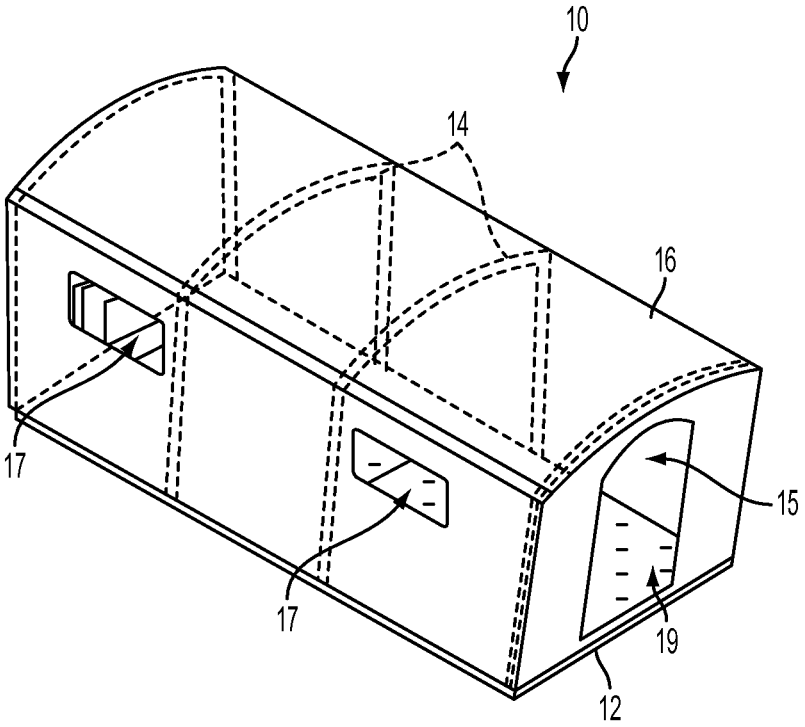
FIG. 1 is a perspective view of a folding tent, according to an exemplary embodiment.

Before discussing further details of the foldable tent and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring in general to FIGS. 1-15, a portable, folding shelter is shown according to an exemplary embodiment as a folding tent 10. The folding tent 10 includes a substantially rigid base assembly 12, a plurality of frame members 14 coupled to the base assembly 12, and a cover 16 supported by the frame members 14 and coupled to the base assembly 12, defining an interior 15. The cover 16 may include openings, shown as windows 17 and a door 19, allowing access into the interior 15. The folding tent 10 may also include a panel 18 that is configured to fold upward to a vertical orientation to be received in an opening in the cover 16 and to provide electrical power or other interfaces (e.g., HVAC, water, etc.) to the interior 15 of the tent 10.

Referring to FIG. 4A-4D, the folding tent 10 is convertible between an open configuration and a closed configuration. In the closed or storage configuration (see FIG. 4A), the base assembly 12 is folded closed and the frame members 14 and the panel 18 are folded flat against the base assembly 12. The base assembly 12 defines an enclosed space in which the frame members 14 and the cover 16 are stored. In the open configuration (see FIG. 4C), the base assembly 12 is folded open, with the frame member 14 extending upward from the base assembly 12. The panel 18 may then be rotated to a vertical position (see FIG. 4D). The convertible nature of the folding tent 10 facilitates the transport, erection, and collapsing of the folding tent 10.

The base assembly 12 includes a first base portion 20 and a second base portion 22. The base portions 20 and 22 are rectangular members that are laid end to end along adjacent hinge edges 26 and joined together with a hinge 24 such that they can pivot about a hinge axis 25. As shown, in one embodiment, two hinges 24 may be disposed at the corners of the base portions 20 and 22, coupled to the side edges 28. In other embodiments, the base portions 20 and 22 may be coupled together with multiple separate hinges coupled to the hinge edges 26 or to a single hinge that extends along the hinge edges 26. In other embodiments, the base assembly 12 may include more than two hinged base portions. For example, the base assembly 12 may include three or more base portions arranged end to end and connected by parallel hinges or may include base portions arranged in a grid pattern that are connected with hinges.

Figure 5:
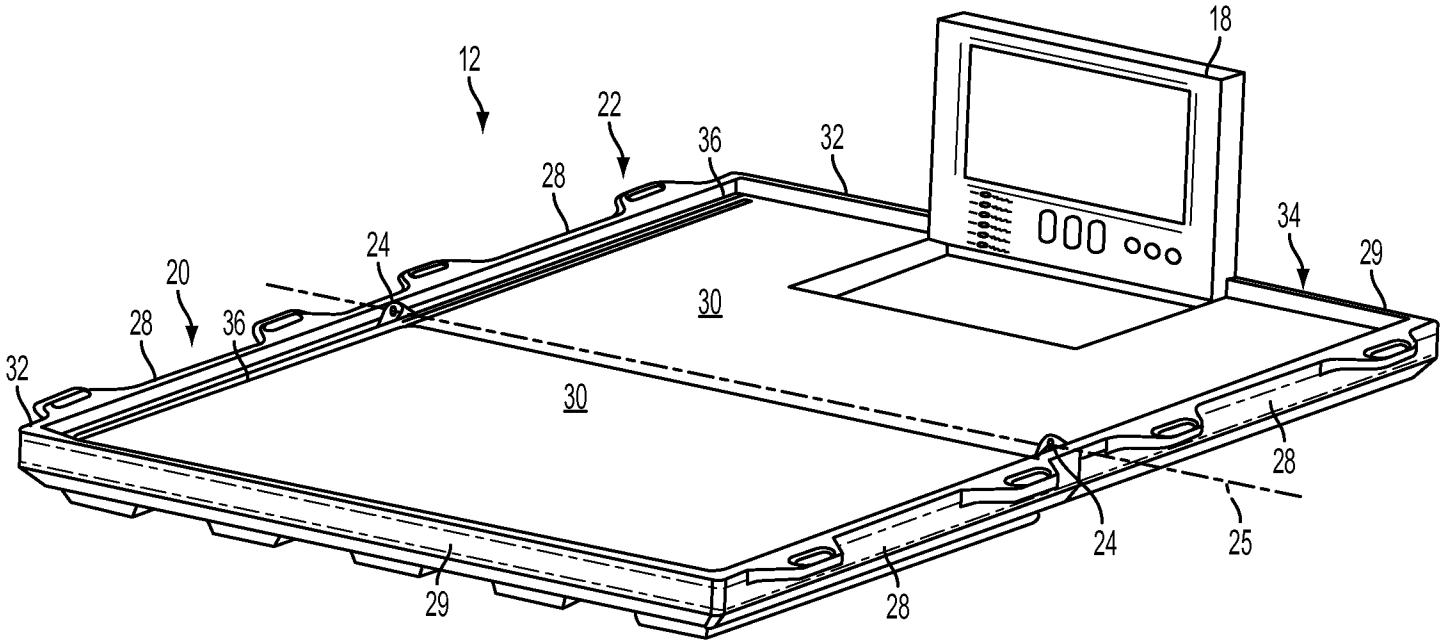
FIG. 5 is a perspective view of a rigid base for the tent of FIG. 1.

Referring now to FIG. 5, the base portions 20 and 22 each include a central platform 30. The platform 30 provides a relatively flat upper surface for an occupant of the tent 10. The platform 30 is surrounded on the side edges 28 and on an edge 29 opposite the hinge edge 26 by a raised ridge 32 (rim, lip, wall, etc.) that, when the tent 10 is in the open configuration, extends about the periphery of the base assembly 12. The hinges 24 are formed such that the hinge axis 25 lays along a plane raised above the platform 30. In an exemplary embodiment, ridge 32 is a constant height and the hinge axis 25 lays along the same plane as the upper surface 34 of the ridges 32. In the closed configuration, the upper surface 34 of the ridge 32 on the first base portion 20 confronts the upper surface 34 of the ridge 32 on the second base portion 22. In other embodiments, the ridge 32 and the hinge 24 may be otherwise configured. For example, the ridge 32 on the first base portion 20 may be a different height above the platform 30 than the ridge 32 of the second base portion 22, and the hinge axis 25 may lay along a plane between the heights of the ridges 32 such that, in the closed configuration, the upper surface 34 of the ridge 32 on the first base portion 20 confronts the upper surface 34 of the ridge 32 on the second base portion 22. In other embodiments, the ridges 32 may be contoured (e.g., scalloped, crenelated, slanted, etc.) such that the ridges 32 interlock in the closed configuration. In still another embodiment, the hinge axis 25 may lay along a plane above the upper surfaces 34 of both the ridges 32 such that a gap remains between the ridges 32 in the closed configuration.

The base assembly 12 further include rail members, shown as channel rails 36 disposed along the sides of the base portions 20 and 22. The channel rails 36 extending in a direction generally orthogonal to the hinge axis 25 and parallel to the side edges 28. A pair of channel rails 36 are provided on the upper surface of the first base portion 20. A second pair of channel rails 36 are provided on the upper surface of the second base portion 22 that are aligned with the channel rails 36 on the first base portion 20 when the tent 10 is in the open configuration. According to an exemplary embodiment, the channel rails 36 are provided within recesses 38 (e.g., grooves, slots, etc.) such that the channel rails 36 are recessed below the platform 30 (see FIG. 9).

Figure 6:
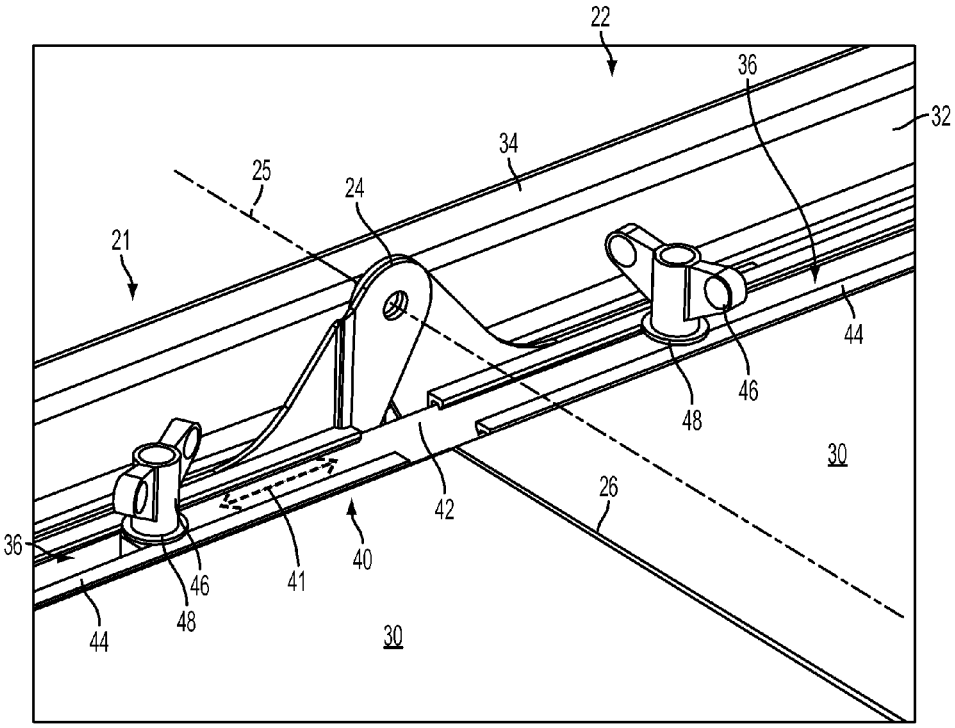
FIG. 6 is a perspective view of a locking mechanism for the rigid base of FIG. 5, according to an exemplary embodiment.

Referring now to FIG. 6, in some embodiments, locking members 40 are provided to allow the tent 10 to be locked in the open configuration. According to an exemplary embodiment, the locking member 40 includes a bar 42 disposed within the aligned channel rails 36. The bar 42 is trapped within the channel rail 36 by inwardly extending lips 44. The bar 42 is able to slide along the length of the aligned channel rails 36 on either side of the base assembly 12 along arrow 41. When the bar 42 is disposed wholly within one of the channel rails 36, the base portions 20 and 22 are allowed to pivot freely about the hinge axis 25. When the base assembly 12 is in the open configuration such that two channel rails 36 are aligned and the bar 42 is disposed such partially within each of two aligned channel rails 36, the base portions 20 and 22 are prevented from pivoting about the hinge axis 25, locking the base assembly 12 in the open configuration. Handles 46 are coupled to the bar 42 with a threaded connection. The bar 42 may be held in position along the length of the channel rail 36 by tightening the handles 46, thereby compressing the inwardly extending lips 44 between the bar 42 and washers 48 disposed above the channel rail 36. In other embodiments, the bar 42 may be held in position along the length of the channel rail 36 by another mechanism, such as a spring-loaded mechanism.

In another embodiment, the tent 10 may include a locking member that is disposed elsewhere, outside the channel rails 36, such as along the side of the base assembly 12. The locking member may be an elongated member 56 disposed in a channel 58 (see FIG. 12) extending between the first base portion 20 and the second base portion 22. The locking member can be slid in the channel between an unlocked position, in which it is disposed only in the first base portion 20 or the second base portion 22, and a locked position, in which it is disposed in both the first base portion 20 and the second base portion 22. In still other embodiments, the tent 10 may be locked in the open configuration with a variety of mechanisms. For example, the tent 10 may be locked in the open configuration with a member that directly engages the hinge (e.g., a pin, clamp, latch, etc.) or with a removable member that engages the base portions 20 and 22.

Referring back to FIGS. 4A-4D, the base assembly 12 may include members, shown as U-shaped handles 54, to facilitate the transport of the tent 10 and the reconfiguration of the tent 10 between the open and closed configuration. According to an exemplary embodiment, a pair of handles 54 are provided on either side edge 28 of the first base portion 20 and the second base portion 22. When the base portions 20 and 22 are folded together in the closed configuration, the handles 54 of the first base portion 20 are aligned with the handles 54 of the second base portion 22. According to an exemplary embodiment, the handles 54 are integrally formed with the first base portion 20 and the second base portion 22. In other exemplary embodiments, the handles 54 may be separate members coupled to the side edges 28 of the base portions 20 and 22. In other embodiments, the handles 54 may be members that can be retracted (e.g., slid, folded, etc.) against the side edges 28 or into the base portions 20 and 22.

Figure 7:
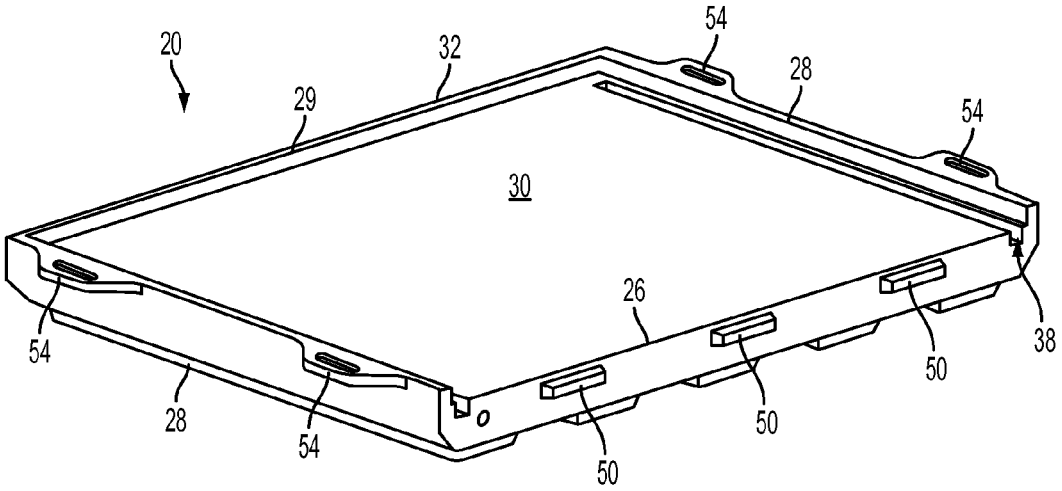
FIG. 7 is a perspective view of a portion of the rigid base of FIG. 5.
Figure 8:
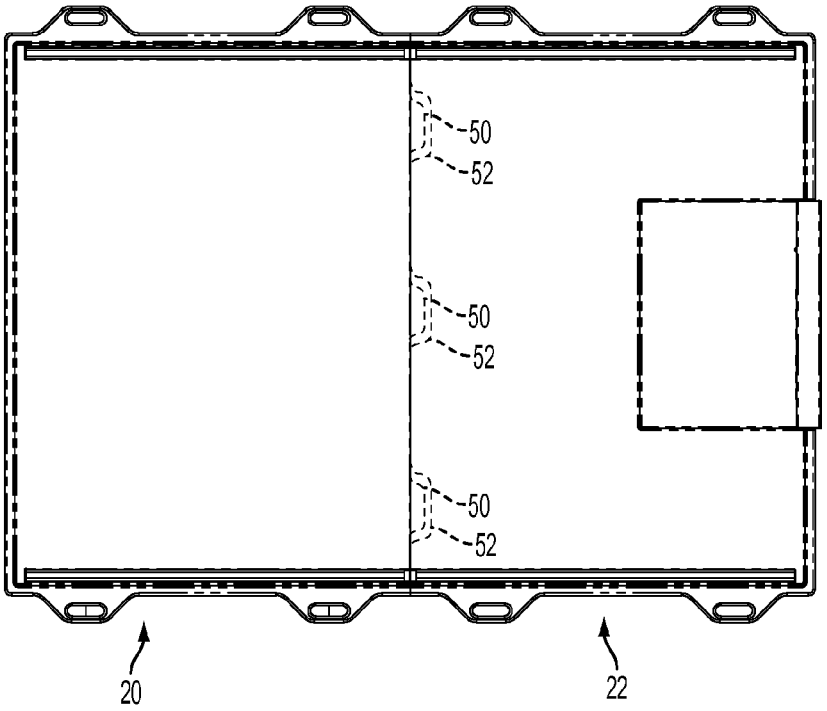
FIG. 8 is a top plan view of the rigid base of FIG. 5.

Referring to FIGS. 7-8, the base assembly 12 may include additional members to stabilize the base assembly 12 in the open configuration. According to an exemplary embodiment, the first base portion 20 includes one or more projections 50 extending outward from the hinge edge 26. In the open position, the projections 50 engage corresponding recesses 52 extending inward from the hinge edge 26 of the second base portion 22. Through the interconnection of the projections 50 and the recesses 52, the first base portion 20 is coupled to the second base portion 22, not only at the corners by the hinges 24, but also at the platform 30 along the hinge edges 26. As shown, the projections 50 and the corresponding recesses 52 may be trapezoidal. In other embodiments, the projections 50 and the corresponding recesses 52 may be otherwise shaped (e.g., cylindrical, semicircular, triangular, conical, rectangular, etc.). In other embodiments, the projections 50 and the corresponding recesses 52 may have different shapes. For example, the projections 50 may be trapezoidal while the recesses 52 may be rectangular. In other embodiments, the first base portion 20 and the second base portion 22 may be otherwise interconnected when the base assembly 12 is in the open configuration. For example, the hinge edges 26 of the base portions 20 and 22 may be contoured (e.g., scalloped, serrated, crenelated, etc.) such that the hinge edges 26 engage each other when the base assembly 12 is in the open configuration. In other embodiments, the base portions 20 and 22 may include openings that are engaged by another member, such as a bar or rod disposed in a direction parallel to the hinge axis 25, to further couple the base portions 20 and 22 together along the hinge edges 26.

In some embodiments, the base assembly 12 may include features similar to the projections 50 and the recesses 52 along the outer periphery of the base 12 (e.g., along edges 28 and 29) to facilitate the joining of multiple base assemblies 12 together to form a portable shelter having a larger interior and footprint.

Figure 9:
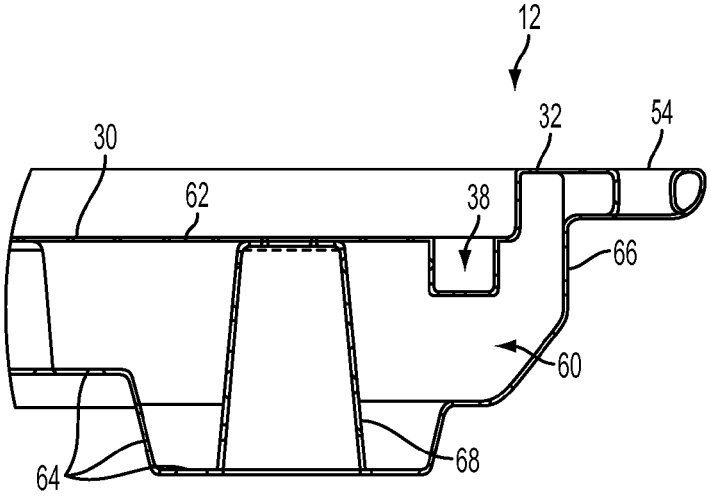
FIG. 9 is a cross-section view of the rigid base of FIG. 5, taken along line 9-9.

Referring now to FIG. 9, each of the base portions 20 and 22 may have a hollow interior 60 defined by a top wall 62 (e.g., a wall forming the platform 30), a bottom wall 64 and side walls 66 (e.g., walls forming the edges 26, 28, and 29). The hollow interior 60 reduces the overall mass of the base portions 20 and 22 to facilitate the transport, erection and collapsing of the tent 10. Internal structures, shown as frustoconical supports 68 may be provided in the interior 60 to support the mass of an occupant of the tent 10 standing on the top wall 62. Supports 68 may be distributed about base portions 20 and 22 in any pattern to provide desired support. In other embodiments, the internal structures may be other structures, such as ribs, corrugated members, or any other structure configured to support the mass of an occupant of the tent 10. Additionally, the hollow interior 60 provides an insulating layer of air between the top wall 62 and the bottom wall 64, thereby decreasing the heat loss from the interior of the tent 10 to the ground through conduction.

The hollow interior 60 also allows the base portions 20 and 22 to be filled, such as with a liquid, to selectively increase the mass of the base assembly 12 and increase the stability of the tent. The hollow interior 60 may be filled with a liquid through a fill opening provided in a wall (e.g., the top wall 62, the side walls 66, etc.) in the open configuration. The liquid can be emptied from the hollow interior 60, either through the fill opening or through another opening provided below the fill opening (e.g., the bottom wall 64, a lower portion of the side walls 66, etc.). The liquid may be emptied from the hollow interior to reduce the mass of the base assembly 12, such as before the tent 10 is folded into the closed configuration for transport.

According to an exemplary embodiment, the bottoms 70 of the base portions 20 and 22 are contoured. When the tent 10 is in the open configuration, the bottoms 70 of the base portions 20 and 22 form the bottom of the base assembly 12 and the provide the structure that confronts the surface upon which the tent 10 rests, such as the ground. When the tent 10 is in the closed configuration, the bottoms 70 of the base portions 20 and 22 form the exterior surface of the folded body. As shown in FIGS. 2, 4A-4D, and 10, in one embodiment, the contoured bottoms 70 include a multitude of raised portions, shown as ribs 72, the ribs 72 defining through passages, shown as channels 74 between the ribs 72. When the tent 10 is in the open configuration, the tent 10 rests on the ribs 72, allowing liquids (e.g., rain water, spills, etc.) and air to pass through the channels 74. The channels 74 reduce the likelihood that water will collect around the base assembly 12, dislodging the tent 10 or flowing over the edges of the base assembly 12 into the interior 15. Instead, water flowing or collecting on the surface of the ground is able to flow from one side of the base assembly 12 to the other side of the base assembly 12. The raised ribs 72 provide a sufficient surface area to support the tent 10 and any occupants of the tent 10 without sinking into the ground. According to an exemplary embodiment, the ribs 72 extend in a direction perpendicular to the hinge axis 25. In other embodiments, the ribs 72 may extend in a different direction, such as parallel to the hinge axis 25 or at another angle relative to the hinge axis 25. In still other embodiments, the raised portions may be other bodies forming through passages under the base assembly 12, such as multitude of posts or walls.

In other embodiments, the base assembly 12 may be configured to receive risers, legs, or other members coupled to the bottom of the base assembly 12 to further raise the base assembly 12 off the surface upon which the tent 10 rests. The members may snap onto the ribs 72 or other surface features of the base assembly 12 or may be received in sockets (e.g., smooth bore or threaded apertures) in the base assembly 12. The members may be configured to fold against the base assembly 12 or may be removable.

Figure 10:
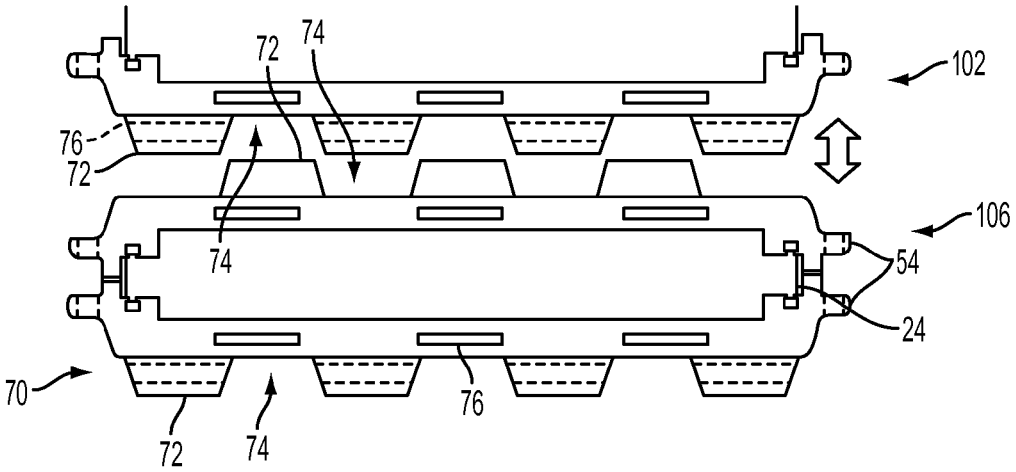
FIG. 10 is a side elevation view of two tents stacked in a closed configuration.

In the closed configuration, the ribs 72 and the channels 74 are disposed on the top and bottom of the folded base assembly 12. The ribs 72 on the first base portion 20 and on the second base portion 22 are staggered. The ribs 72 and the channels 74 are configured such that the ribs 72 can be received inside the channels 74. Referring to FIG. 10, a first tent 10*a* can therefore be stacked atop a second tent 10*b* such that the ribs 72 interlock, with the ribs 72 of the first tent 10*a* being received in the channels 74 of the second tent 10*b* and the ribs 72 of the second tent 10*a* being received in the channels 74 of the first tent 10*b*.

The base portions 20 and 22 are formed from materials that are rugged (i.e., able to withstand the weight and wear from an occupant and withstand abrasion from the surface supporting the tent 10) and resistant to rot, corrosion, and the formation of mold and mildew. The base portions 20 and 22 may be formed for example, from a polymer material (e.g., polypropylene, polyethylene etc.), a metal or metal alloy, or a composite material (e.g., fiberglass reinforced polymer, etc.). In some embodiments, the base portions 20 and 22 may be formed from multiple materials. For example, the base portions 20 and 22 may have walls 62, 64, and 66 forming a rigid shell, while an additional pliant layer may be formed on the top wall 62 to provide a more comfortable surface on the platform 30. The bottom wall 64 may be formed from a material being especially resilient to abrasions from the surface supporting the tent 10.

The base assembly 12 may be further configured to facilitate the transport of the tent 10 in the closed configuration. Referring to FIG. 10, according to an exemplary embodiment, the ribs 72 may include slots 76 configured to receive the forks on a lifting device, such as a forklift, hand jack, or other device configured to lift pallets. In other embodiments, the ribs 72 and the channels 74 may be sized and spaced to receive the forks on a lifting device. The dimensions of the tent 10 in the closed configuration (e.g., the width, depth, and height of the folded base assembly 12) may be configured to allow the tent 10 to be transported in a shipping crate or container having a standardized size, on a flatbed truck, in a railcar, etc. In some embodiments, the base assembly 12 may include wheels or sockets to receive removable wheels.

Figure 2:
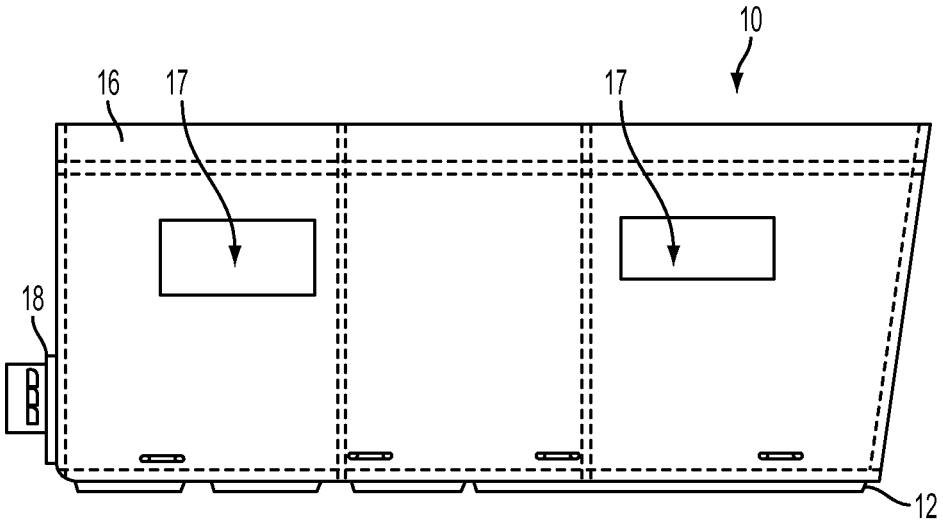
FIG. 2 is a side elevation view of the folding tent of FIG. 1.
Figure 3:
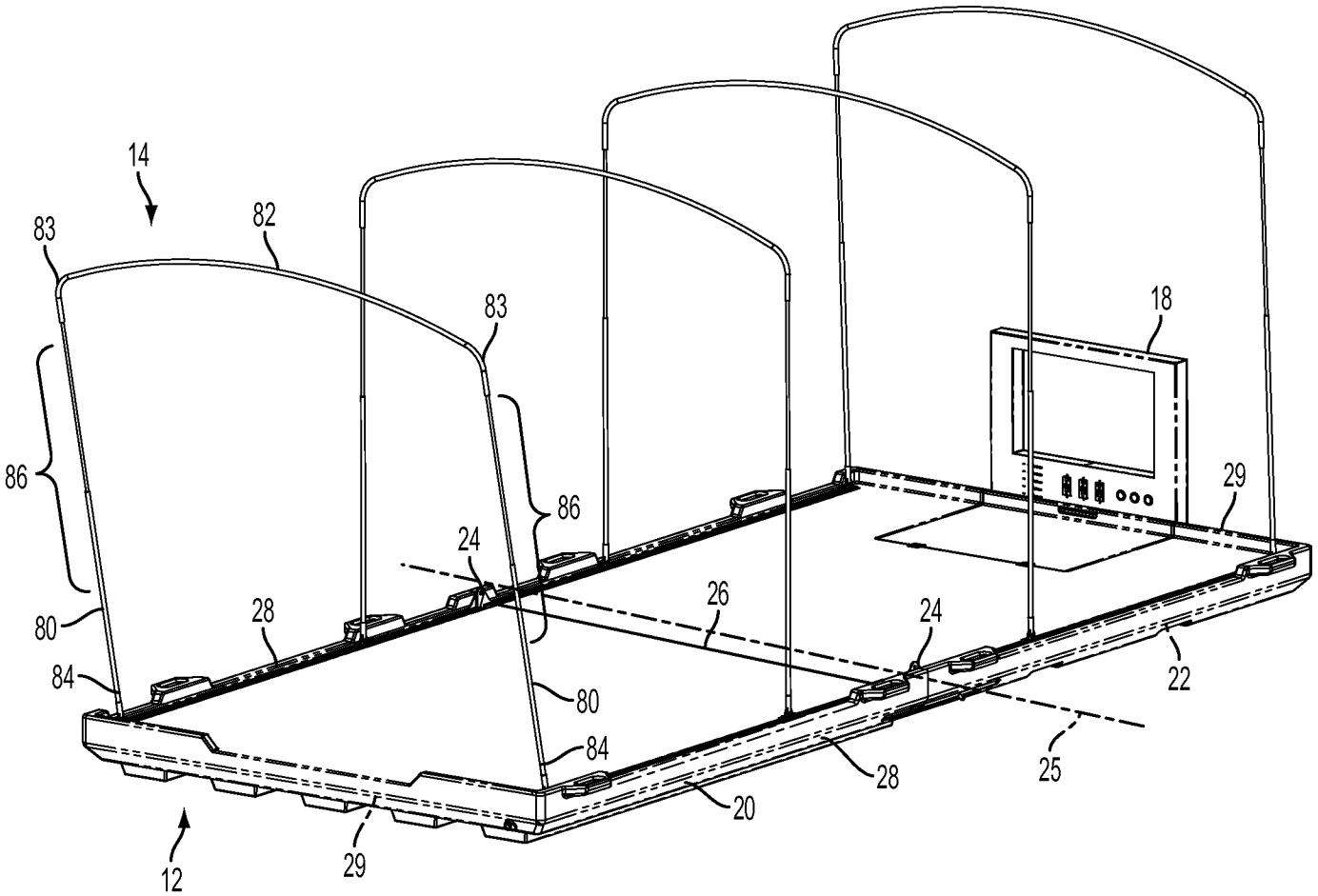
FIG. 3 is a perspective view of the folding tent of FIG. 1 with the cover removed.
Figure 4A:
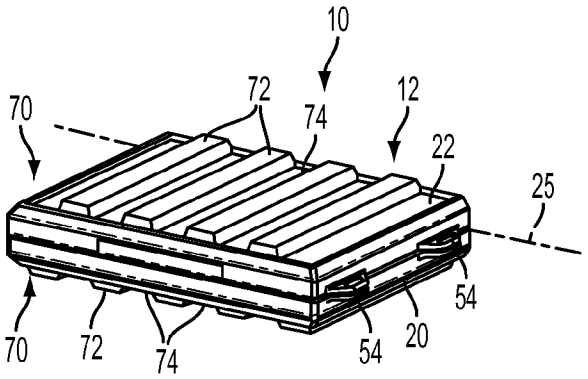
FIGS. 4A-4D are perspective views of the rigid base of FIG. 4 being converted between a closed configuration and an open configuration.
Figure 4B:
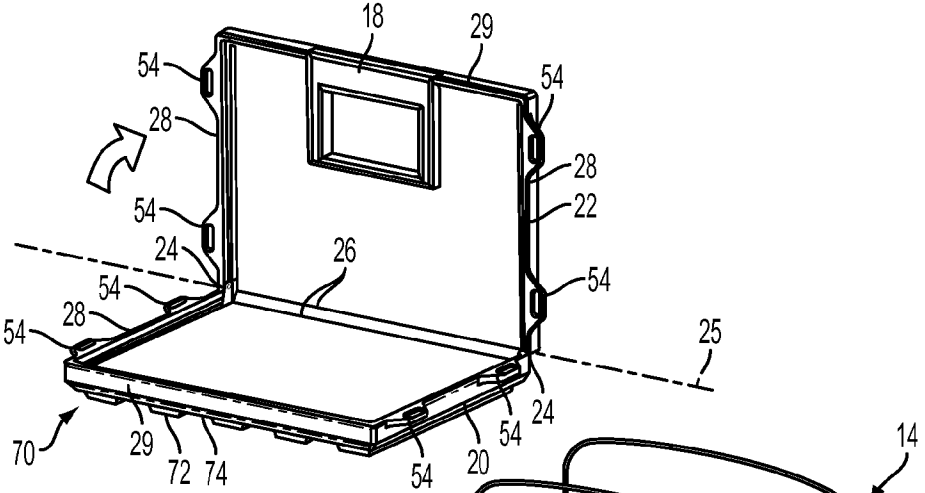
Figure 4C:
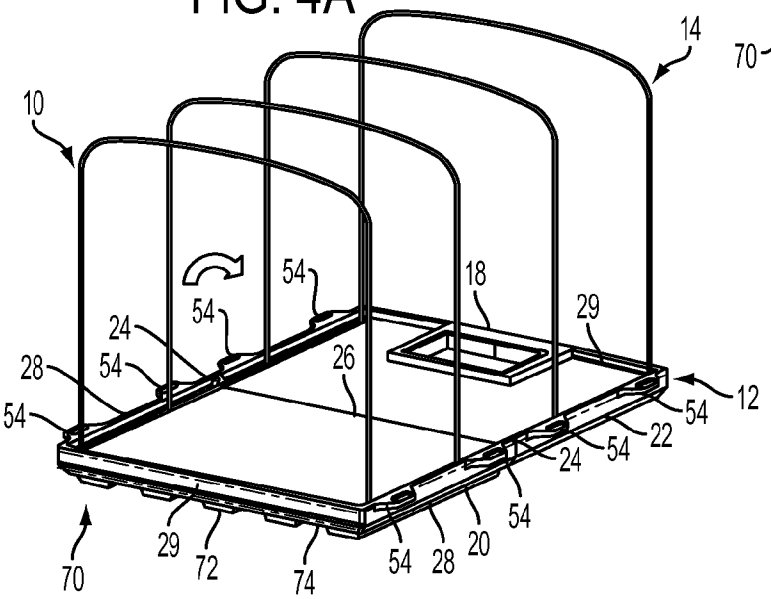
Figure 4D:
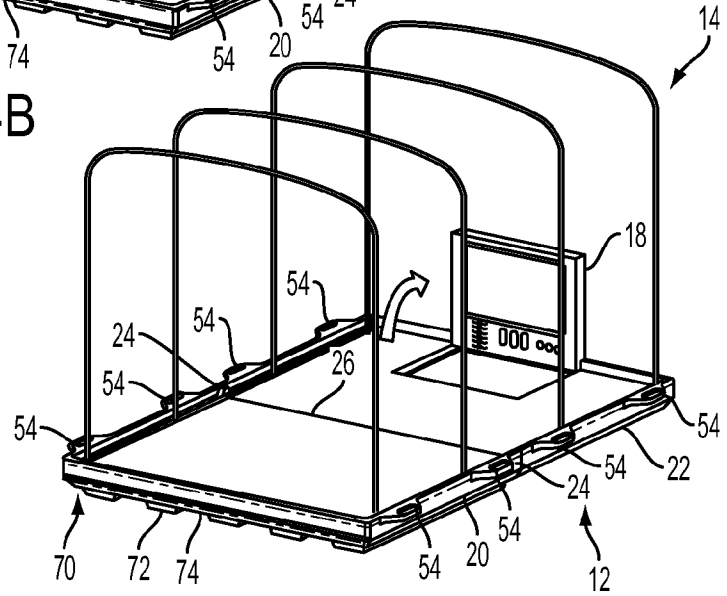
Figure 11:
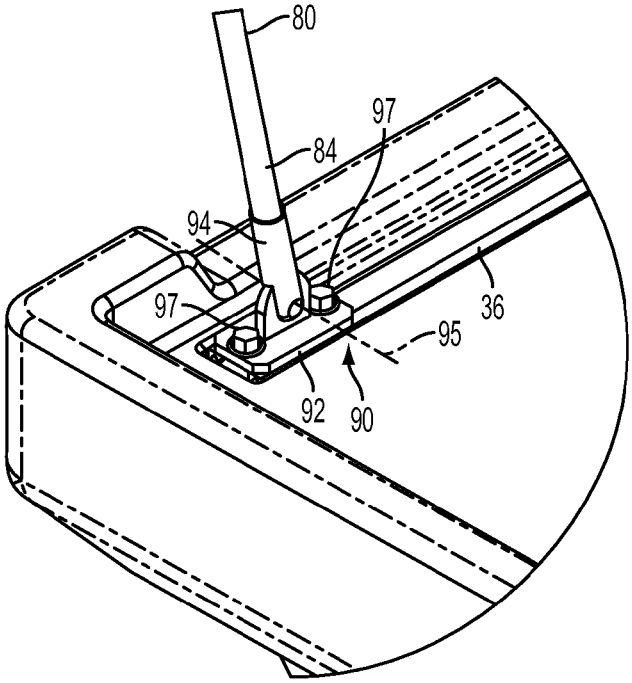
FIG. 11 is a detail perspective view of a connector for coupling an end of a frame member to the rigid base.

Referring now to FIGS. 3 and 11, the frame members 14 are shown in one embodiment to be U-shaped members including side portions 80 providing support to the sides of the cover 16 and a transverse portion 82 extending between the side portions 80 and providing support to the top of the cover 16. The transverse portion 82 is coupled to the side portions 80 with corner portions 83. The corner portions 83 may have a radius, as shown in FIG. 3, to provide a gradual transition between the side portions 80 and the transverse portion 82. The transverse portion 82 may be a curved (e.g., bowed, arched, curvilinear, etc.) member to minimize the collection of water, snow, or debris on the top of the tent 10. In other embodiments, the frame members 14 be otherwise shaped (e.g., semicircular, arched, V-shaped, etc.). The frame members 14 may have a relatively consistent height, as shown in FIG. 2, such that the top of the tent 10 is flat. In other embodiments, the frame members 14 may have varied heights such that the top of the tent 10 is curved.

According to an exemplary embodiment, the frame members 14 are thin-walled tubular members having a circular cross-section shape to reduce the mass of the frame members 14 while still providing sufficient stiffness and strength to support the cover 16. In other exemplary embodiments, the frame members 14 may have another cross-section shape (e.g., hexagonal, oval, rectangular, etc.). In still other embodiments, one or more of the frame members may be another structural member (e.g., rod, bar, channel, etc.).

According to an exemplary embodiment, connectors 90 and the frame members 14 are configured such that the frame members 14 remain coupled to the base assembly 12 as the tent is converted between the open configuration and the closed configuration. In other embodiments, one or more of the frame members 14 may be removed from the base assembly 12 to be collapsed and stored within the base assembly 12 in the closed configuration. In some embodiments, the tent 10 may include additional cross-members (not shown) that are connected between the frame members 14 when in the open configuration to increase the structural rigidity of the tent 10.

Figure 12:
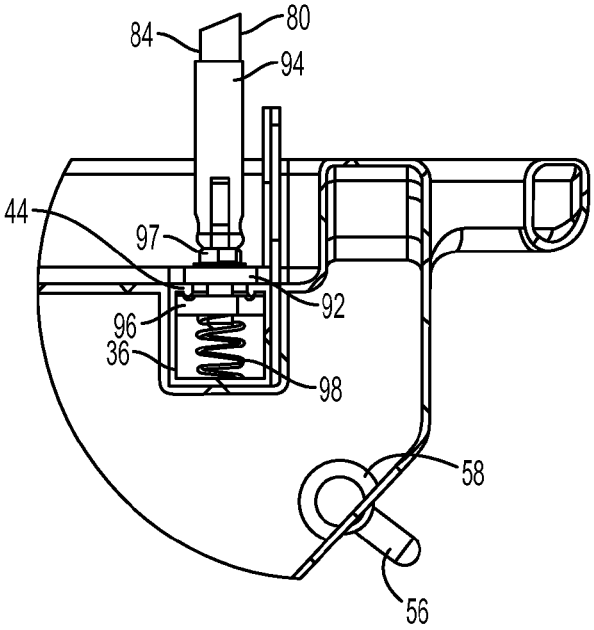
FIG. 12 is a cross-section view of a rail for the tent of FIG. 3, taken along line 12-12.

Referring now to FIGS. 11-12, a connector 90 is shown in more detail according to an exemplary embodiment. The distal ends 84 of the frame members 14 are coupled to the base assembly 12 with connectors 90 that engage the channel rails 36. The connectors 90 are configured to allow the frame members 14 to slide in the channel rails 36 along the length of the base assembly 12 (e.g., in a direction perpendicular to the hinge axis 25) to vary the spacing of the frame members 14. The connectors 90 further allow the frame members 14 to pivot relative to the base assembly 12. The connector 90 includes hinge formed by a main body 92 and a cap 94 receiving a distal end 84 of a frame member 14 and pivotably coupled to the main body 92 at a pivot axis 95. The main body 92 is disposed outside of the channel rail 36 and is coupled to members disposed within the channel rail 36, shown as captured nuts 96 engaging bolts 97. The inwardly extending lips 44 of the channel rail 36 are trapped between the main body 92 and the captured nuts 96. Biasing members, shown as coil springs 98, force the captured nuts 96 against the inwardly extending lips 44, creating friction between the connector 90 and the channel rail 36 to stop the sliding of the connector 90 along the length of the channel rail 36. The frame member 14 can be slid along the length of the channel rail 36 by pushing down on the connector, compressing the coil springs 98 and pushing the captured nuts 96 away from the from the inwardly extending lips 44.

As shown in FIG. 3, in the open configuration, the frame members 14 extend upward from the base assembly 12. The frame members 14 may be oriented such that the side portions 80 are vertical or may be oriented such that the side portions 80 are skewed at an angle relative to vertical. In the closed configuration, the frame members 14 are pivoted about the connectors 90 until the frame members 14 lay flat against the base assembly. By first sliding the frame members 14 to one side of the base portions 20 or 22 (e.g., towards the hinge edges 26 or towards the edges 29), the frame members 14 can be folded against the base portions 20 or 22 and contained within the base assembly 12 in the closed configuration.

The frame members 14 may include a variable height mechanism, shown as telescoping portions 86, by which the length of the side portions 80 is varied. The frame members 14 may be reduced in length by collapsing the telescoping portions 86 (e.g., to store the frame members 14 in the base assembly 12 in the closed configuration) or increased in length by extending the telescoping portions 86. The tent 10 may therefore have a height that is greater than the length of the first base portion 20 or the second base portion 22.

Figure 13:
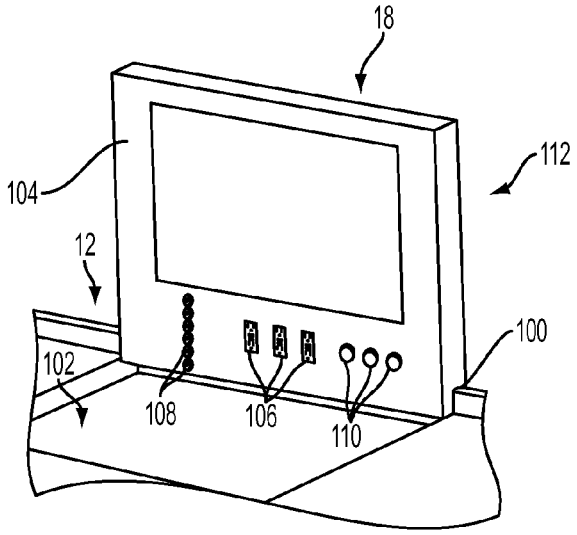
FIG. 13 is a perspective view of a power panel for the tent of FIG. 1.
Figure 14:
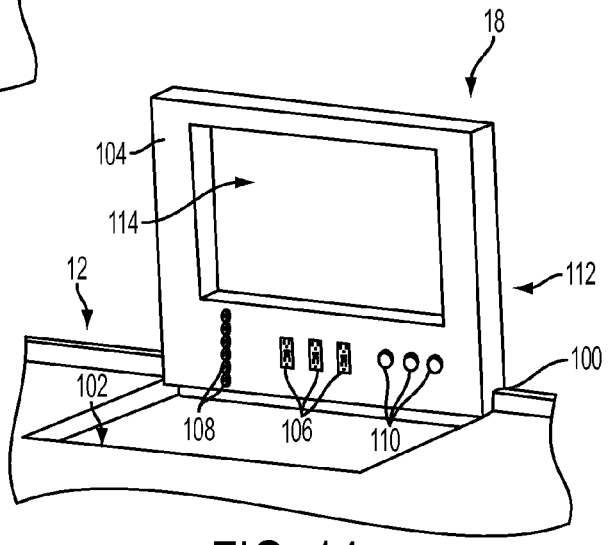
FIG. 14 is a perspective view of the power panel of FIG. 13 with a central portion removed to accommodate an air conditioner.
Figure 15:
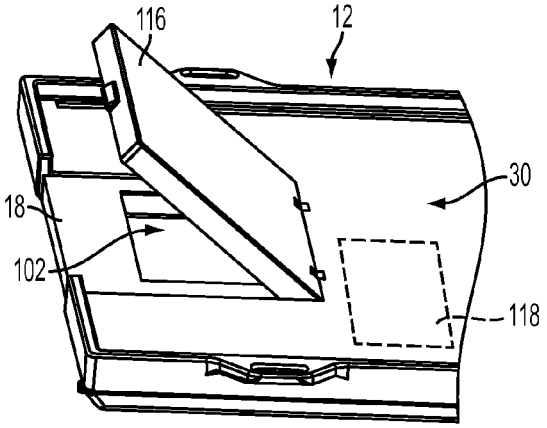
FIG. 15 is a perspective view of an internal cover for the power panel of FIG. 13, according to an exemplary embodiment.

Referring to FIG. 13-15, the panel 18 is shown in more detail. The panel 18 may be optionally included to allow an occupant of the tent 10 to access a power source (e.g., a generator, the electrical grid, etc.) located outside the tent 10. The panel 18 is moveable between a horizontal position and a vertical position. In the horizontal position, the panel 18 is folded downward via a hinge 100 to be received in a recess 102 in the base assembly 12. In the vertical position, the panel 18 is folded upward to a vertical position along an edge of the base assembly 12. The cover 16 may be configured to accommodate the panel 18, such as with a flap or removable section creating an opening sized to receive the panel 18. The edges of the cover 16 may be coupled to the edges of the panel 18 in a weatherproof fashion to prevent the ingress of wind, moisture, or debris into the interior 15 of the tent 10.

The interior side 104 of the panel 18 includes a multitude of interfaces usable from the interior 15. According to an exemplary embodiment, the panel 18 may include a variety of interfaces, such as one or more electrical outlets 106, one or more controls 108, and one or more additional inputs/outputs 110 (e.g., A/V inputs/outputs, etc.). Additionally, interfaces (e.g., valves, etc.) for water, air, or other equipment may be included. The exterior side 112 of the panel 18 may include corresponding interfaces configured to be coupled to devices and systems located outside of the tent 10. The exterior interfaces may include covers or be otherwise configured to protect the interfaces against the exterior conditions.

Referring now to FIG. 14, the panel 18 may include a removable portion that may be removed to define an opening 114 in the panel 18. The opening 114 may be configured, for example, to receive HVAC equipment (e.g., a heater, a fan, an air conditioner, etc.). The HVAC equipment may be controlled via controls on the HVAC equipment. In other embodiments, the HVAC equipment may be configured to interact with the panel 18 such that the HVAC equipment is controlled with the interfaces provided by the panel 18.

Referring now to FIG. 15, in some embodiments, a hatch or cover 116 may be provided to cover the recess 102 in the base assembly 12. In the horizontal position, the cover 116 conceals the panel 18 in the recess 102. The cover 116 may be opened (e.g., pivoted about a hinge, removed, etc.) to allow access to the panel 18 so that the panel 18 may be rotated out of the recess 102 into the vertical position. In the vertical position, the cover 116 may be closed to cover the empty recess 102. The cover 116 may be configured to form a continuous surface with the platform 30 when it is closed, thereby providing a continuous surface for the occupant of the tent 10 whether or not the panel 18 is in use.

The base assembly 12 may include additional storage compartments 118 similar to the recess 102 and closed with members similar to the cover 116. The additional storage compartments 118 may be configured to contain various useful items, such as tools, survival supplies, medical supplies, food, etc.

It should be understood that the construction and arrangement of the elements of the various embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the components and/or assemblies disclosed herein may be constructed from any of a wide variety of materials that provide sufficient strength or durability, in any of a wide variety of colors, textures, and combinations.

What is claimed is:

1. A self-contained folding shelter, comprising:

a rigid base comprising a first base portion and a second base portion;

a hinge coupled to the first base portion and the second base portion and defining a hinge axis such that the first base portion and the second base portion are pivotally movable between an open configuration and a closed configuration;

a first pair of rail members disposed along the sides of the first base portion and a second pair of rail members disposed along the sides of the second base portion, the first and second pairs of rail members extending generally orthogonal to the hinge axis, and the first pair of rail members being aligned with the second pair of rail members when the first and second base portions are in the open configuration;

a plurality of frame members, the plurality of frame members including at least a first frame member pivotally and translationally coupled to the first pair of rail members such that the first frame member is configured to pivot relative to the first pair of rail members and translate along a length of the first pair of rail members, and a second frame member pivotally and translationally coupled to the second pair of rail members such that the second frame member is configured to pivot relative to the second pair of rail members and translate along a length of the second pair of rail members;

a cover supported by the frame members to define an interior space; and a panel coupled to the rigid base, the panel being pivotable between a substantially horizontal position and a substantially vertical position, the panel being coupled to an edge of the cover when in the vertical position and configured to pass electrical power to the interior space;

wherein, in the closed configuration, the rigid base defines a storage space sized to receive the plurality of frame members, the cover, and the panel.

2. The shelter of claim 1, wherein the rigid base comprises a contoured bottom surface defining a plurality of channels allowing fluids to pass underneath the rigid base.

3. The shelter of claim 2, wherein the contoured bottom surface comprises a plurality of ribs extending in a direction perpendicular to the hinge axis.

4. The shelter of claim 3, wherein the plurality of channels are sized and spaced apart to receive the plurality of ribs in an interlocking fashion such that a first shelter in the closed configuration can be stacked atop a second shelter in the closed configuration.

5. The shelter of claim 2, wherein the rigid base is configured to receive the forks from a device configured to lift pallets.

6. The shelter of claim 1, wherein the rigid base is formed from a material resistant to corrosion and mold growth.

7. The shelter of claim 1, wherein the rigid base comprises a hollow body capable of being filled with a fluid.

8. The shelter of claim 1, comprising a first handle coupled to the first rigid base portion and a second handle coupled to the second rigid base portion, the first handle being aligned with the second handle when the shelter is in the closed configuration.

9. The tent of claim 1, wherein the first base portion includes first edge having a protrusion extending therefrom and the second base portion includes a second edge defining a recess, wherein when the first and second base portions are in the open configuration, the first edge is adjacent the second edge and the protrusion is received within the recess.

10. The shelter of claim 1, wherein each of the plurality of frame members comprise a telescoping section.

11. The shelter of claim 1, wherein the plurality of rail members comprise channels recessed in an upward facing surface of the first rigid base portion and the second rigid base portion.

12. The tent of claim 1, further comprising a locking member configured to be slidably coupled to the first base portion and the second base portion, the locking member moveable between an unlocked position, in which the locking member is disposed only in the first base portion, to a locked position, in which the locking member is disposed in both the first and second base portions, to prevent the pivoting of the first base portion relative to the second base portion.

13. The shelter of claim 1, wherein the panel comprises an opening configured to receive HVAC equipment.

14. A self-contained folding tent, comprising:

a rigid base comprising:

a first rigid base portion having a protrusion extending outward from a hinge edge and a plurality of ribs on a bottom surface defining a plurality of channels therebetween;

a second rigid base portion having a recess extending inward from a hinge edge and a plurality of ribs on a bottom surface defining a plurality of channels therebetween; and a hinge defining a hinge axis and coupled to the hinge edge of the first rigid base portion and hinge edge of the second rigid base portion;

wherein the first rigid base portion and the second rigid base portions are pivotable about the hinge axis between an open configuration and a closed configuration; and wherein, in the open configuration, the protrusion is received in the recess;

a first pair of rail members disposed along the sides of the first rigid base portion and a second pair of rail members disposed along the sides of the second rigid base portion, the rail members extending in a direction generally orthogonal to the hinge axis, and the first pair of rail members being aligned with the second pair of rails when the tent is in the open configuration;

a plurality of frame members, the plurality of frame members including at least a first frame member movably coupled to the first pair of rail members such that the first frame member is configured to pivot relative to the first pair of rail members and translate along a length of the first pair of rail members, and a second frame member movably coupled to the second pair of rail members such that the second frame member is configured to pivot relative to the second pair of rail members and translate along a length of the second pair of rail members;

a locking member configured to be slidably coupled to the first base portion and the second base portion, the locking member moveable between an unlocked position in which it is disposed only in the first rigid base portion and a locked position in which it extends across the hinge axis to be disposed in the first rigid base portion and the second rigid base portion to prevent the pivoting of the first rigid base portion relative to the second rigid base portion;

a cover comprising a flexible, waterproof material, the cover having an outer peripheral edge coupled to the rigid base in a weatherproof manner and being supported by the plurality of frame members to define an interior space; and a panel coupled to the rigid base, the panel being pivotable between a horizontal position and a vertical position, the panel being coupled to an edge of the cover in a weather proof manner when in the vertical position and configured to pass electrical power through the cover to the interior space;

wherein, in the closed configuration, the rigid base defines a storage space sized to receive the plurality of frame members, the cover, and the panel.

15. The tent of claim 14, wherein the plurality of channels are sized and spaced apart to receive the plurality of ribs in an interlocking fashion such that a first tent in the closed configuration can be stacked atop a second tent in the closed configuration.

16. The tent of claim 14, wherein the plurality of channels are sized and spaced apart to receive the forks from a device configured to lift pallets.

17. The tent of claim 14, wherein the rigid base comprises a hollow body capable of being filled with a fluid.

18. The tent of claim 14, wherein the plurality of frame members each comprise a telescoping section.

19. The tent of claim 14, wherein the rail members comprise channels recessed in an upward facing surface of the first rigid base portion and the second rigid base portion.

20. A folding frame for a flexible cover, comprising:

a rigid base comprising a first rigid base portion and a second rigid base portion arranged end to end along adjacent edges;

a hinge coupled to the first rigid base portion and the second rigid base portion, the first rigid base portion and the second rigid base portions being pivotable about a hinge axis defined by the hinge between an open configuration and a closed configuration;

a plurality of frame members, the plurality of frame members including at least a first frame member movably coupled to a first pair of rail members such that the first frame member is configured to pivot relative to the first pair of rail members and translate along a length of the first pair of rail members, and a second frame member movably coupled to a second pair of rail members such that the second frame member is configured to pivot relative to the second pair of rail members and translate along a length of the second pair of rail members;

a locking member configured to be moveable between an unlocked position in which it is disposed in the first rigid base portion and a locked position in which it is disposed in both the first rigid base portion the second rigid base portion to prevent the pivoting of the first rigid base portion relative to the second rigid base portion;

wherein, in the open configuration, the plurality of frame members are configured to support a flexible cover to define an interior space and;

wherein, in the closed configuration, the rigid base defines a storage space sized to receive the plurality of frame members and the flexible cover.

* * * * *